US005665064A

United States Patent [19]

Bodicky et al.

[11] Patent Number: 5,665,064

[45] Date of Patent: Sep. 9, 1997

[54] GASTROENTERIC FEEDING TUBE FOR ENDOSCOPIC PLACEMENT AND METHOD OF USE

[75] Inventors: Raymond O. Bodicky, Mehlville; Ronald Crouther, Chesterfield, both of Mo.

[73] Assignee: Sherwood Medical Company, St. Louis, Mo.

[21] Appl. No.: 439,610

[22] Filed: May 12, 1995

Related U.S. Application Data

[63] Continuation of Ser. No. 163,210, Dec. 6, 1993, abandoned.

[51] Int. Cl.[6] ..... A61M 31/00

[52] U.S. Cl. ..... 604/54; 604/170; 604/270; 600/156

[58] Field of Search ..... 604/27, 30–31, 604/34, 35, 170, 270, 49, 54; 600/120, 117, 104, 101, 153–154, 156

[56] References Cited

U.S. PATENT DOCUMENTS

| | | | |
|---|---|---|---|
| 4,474,174 | 10/1984 | Petruzzi . | |
| 4,631,054 | 12/1986 | Kim . | |
| 4,644,936 | 2/1987 | Schiff | 604/165 |
| 4,659,328 | 4/1987 | Potter et al. | 604/164 |
| 4,850,983 | 7/1989 | Brenneman et al. | 604/270 |
| 5,085,216 | 2/1992 | Henley, Jr. et al. | 604/270 |
| 5,242,389 | 9/1993 | Schrader et al. | 604/270 |
| 5,242,429 | 9/1993 | Nwaneri et al. | 604/270 |

*Primary Examiner*—Mark Bockelman

*Attorney, Agent, or Firm*—Gene B. Kartchner; David A. Warmbold; Montgomery W. Smith

[57] ABSTRACT

A gastroenteric feeding tube is provided which is ideally adapted for endoscopic placement through an endoscope having a working channel and a steerable tip. The feeding tube is provided with a longitudinal length sufficient to allow the endoscope to be removed from about the feeding tube without disturbing the distal placement of the feeding tube within the patient's intestines. After the feeding tube has been properly positioned within the patient and the endoscope has been removed from about the feeding tube, a connector is securely attached to the proximal end of the feeding tube to allow it to be connected to a feeding pump, or the like, to provide nourishment to the patient.

21 Claims, 4 Drawing Sheets

GASTROENTERIC FEEDING TUBE FOR ENDOSCOPIC PLACEMENT AND METHOD OF USE

This is a continuation of application Ser. No. 08/163,210 filed on Dec. 6, 1993 now abandoned.

BACKGROUND OF THE INVENTION

1. Field of the Invention

The present invention relates to a medical apparatus and its method of use and more particularly to a gastroenteric feeding tube which is adapted for endoscopic placement into the duodenum area of a patient's intestines.

2. Prior Art

The necessity to provide nutrition for comatose or otherwise debilitated patients has been addressed in various ways by the medical industry. The technique utilized in some cases has been intravenous feeding wherein the nutrients are directly conveyed into the bloodstream of the patient. Another way in which the problem of restoration and maintenance of fluid and nutritional balance is resolved is by means of intubation, where a tube is passed through the nasal passage and into the stomach or intestines of a patient, the tube having one or more apertures to permit the introduction of strained or comminuted foods which can be introduced in fluidized form.

Gastroenteric or nasoenteric feeding tubes have generally been found to be useful for administering the feeding formulas to such patients who are unable to meet their normal nutritional retirements through oral intake of food, but who nevertheless have functional gastrointestinal tracts. Generally, a gastroenteric feeding tube comprises an elongated tubular flexible main portion having distal and proximal ends and includes at least one side aperture therein adjacent the distal end, and a weighted bolus on the distal end. The proximal end of the feeding tube would typically have a single tube connector or a "Y" shaped type connector affixed thereto. A feeding tube of this type is generally installed in a patient so that it extends through one of the patient's nostrils, through the esophagus, into the stomach and preferably past the pylorus into the duodenum area of the intestines. Once a gastroenteric feeding tube has been properly installed in a patient, feeding formula can be effectively administered to the patient by passing it through the tubular main portion so that the formula passes into the patient's intestines through the aperture adjacent the distal end of the main portion.

It is generally preferable to install a feeding tube in a patient so that the distal end portion thereof is positioned past the patient's pyloric valve in either the duodenum or the jejunum area of the patient's intestines. It has been found to be more beneficial if the feeding formula can be passed directly into a patient's intestines rather than into the patient's stomach.

One technique which has heretofore been found to be effective for installing a feeding tube in a patient is to utilize a wire stylet which is inserted into the main lumen of the feeding tube to add stiffness thereto so that it can be manipulated during installation procedures. However, while this method has been effective for installing a feeding tube so that the bolus portion thereof is positioned in the stomach of a patient, it has not been found to be effective for moving the bolus portion of the feeding tube past the pyloric valve of the patient and into the duodenum or jejunum area of the patient's intestines.

Recently, it has been found that endoscopic procedures can be utilized to assist in installing gastroenteric feeding tubes in patients so that the bolus portions thereof are positioned beyond the pyloric valves of patients. In this regard, a number of relatively sophisticated fiber optic endoscopic devices have been developed which can be effectively utilized for assisting in mechanically moving the distal end portions of feeding tubes past the pyloric valves of patients. More specifically, endoscopic devices have been developed which are operable with appliances having grasping or snaring forceps on the distal ends thereof which can be utilized for grasping the ends of feeding tubes to install them in patients. Unfortunately, however, it has been found that most of these endoscopic devices are extremely delicate, and that they cannot be utilized for effectively manipulating feeding tubes having any degree of stiffness. It is also very difficult to pass both the grasping device and feeding tube through the pyloric valve at the same time.

Heretofore, it has been impossible to use a regular enteral feeding tube through the working channel of an endoscope because of the difficulty of removing the endoscope from about the enteral feeding tube once the tube is properly placed past the pyloric valve and into the duodenum of the patient. An endoscope is an instrument for the examination of the interior of a canal or hollow viscus and typically comprises an elongated flexible body having a fiber optic cable to allow its user to view the area surrounding its distal end. Often times, the endoscope additionally has an elongated internal lumen or working channel provided therethrough to allow the user to insert various working instruments through the endoscope to perform various functions within the canal or hollow viscus of a patient. Furthermore, some endoscopes have a steerable distal end to assist in positioning the tip while advancing the endoscope within a patient. However, with enteral feeding tubes of the prior art it is difficult to remove the endoscope from about the feeding tube because the feeding tube would typically have an end connector affixed to its proximal end for hookup to a feeding pump and such a connector would not fit through the working channel of the endoscope. Furthermore, with the use of known feeding tubes it would be impossible to hold the feeding tube in place while removing the endoscope from about the feeding tube without disturbing the feeding tube's placement within the patient.

Accordingly, it is an object of this invention to provide an enteral feeding tube which can be utilized through the working channel of an endoscope and without the use of a separate grasping endoscopic tool.

Another object of this invention is to provide an enteral feeding tube which can be utilized through the working channel of an endoscope such that once the tube is properly positioned within the patient, the endoscope can be removed from about the feeding tube without disturbing the placement of the feeding tube within the patient.

It is another object of this invention to provide an enteral feeding which can be utilized through the working channel of an endoscope which has been inserted into a patient's mouth such that once the tube is properly positioned within the patient, the endoscope can be removed from about the feeding tube and the proximal end of the feeding tube can be repositioned through the patient's nasal passageway without disturbing the distal placement of the feeding tube within the patient.

It is another object of this invention to provide a novel method of placing an enteral feeding tube through the stomach, past the pyloric valve and into the duodenum of a patient through the use of an endoscope having a working channel and a steerable tip.

It is yet another object of this invention to provide a method of properly placing an enteral feeding tube into the duodenum of a patient through the use of an endoscope having a working channel and steerable tip including the steps of positioning the feeding tube within the patient, removing the endoscope from about the feeding tube without disturbing the placement of the feeding tube within the patient, repositioning the proximal end of the feeding tube through the patient's nasal passageway, and connecting an appropriate connector on the proximal end of the feeding tube for connection to a feeding pump and/or solution.

SUMMARY OF THE INVENTION

In accordance with the present invention, a gastroenteric or nasoenteric feeding tube is provided which is ideally adapted for endoscopic placement through an endoscope having a working channel and a steerable tip. More specifically, the present invention provides an enteral feeding tube comprising an elongated tubular flexible main portion having a longitudinally extending lumen therein, the main portion having distal and proximal ends and having at least one side aperture therein adjacent the distal end, a weighted bolus extending in substantially aligned relation from the distal end of the main portion and terminating in a terminal end. The bolus is preferably integrally formed with the main portion of the feeding tube, and preferably has substantially the same cross-sectional dimension and configuration as the main portion. The bolus preferably comprises a tubular wall portion which extends from the distal end of the main portion, means sealing the interior of the wall portion of the bolus from the lumen in the main portion, weight means contained in the wall portion and an end cap for sealing the terminal end of the wall portion of the bolus. The proximal end of the elongated flexible main portion is left open such that the longitudinally extending lumen opens exteriorly to the feeding tube through the proximal end.

A stylet which comprises a metal wire is positioned within the longitudinally extending lumen of the main portion of the feeding tube to provide the tube with sufficient stiffness to be first positioned within the endoscopic tool and then manipulated so that the distal end of the feeding tube can be manipulated to extend beyond the endoscopic tool and through the patient's pyloric valve and into the duodenum. Alternatively, the endoscopic tool with feeding tube positioned therein could be manipulated so that the endoscope's distal end extends through the patient's pyloric valve and into the patient's duodenum.

In one embodiment of the present invention, the elongated main portion of the feeding tube is at least twice the length of the endoscope's tubular body. Typically, the length of the feeding tube would be in the range of 240 to 300 cm and the length of the endoscope would be approximately 100 cm. Once the feeding tube is positioned so that it's distal end is positioned within the patient's duodenum, then the endoscope is backed off the feeding tube while holding a proximal portion of the feeding tube stationary within the patient so that the endoscope can be removed from the patient's body without disturbing the position of the distal end of the feeding tube. After the endoscope is removed from about the feeding tube, the stylet can also be removed from the feeding tube since it is no longer necessary for the feeding tube to have sufficient stiffness for longitudinal movement within the patient's body. The proximal end of the feeding tube can be repositioned so that it exits the patient's body through the patient's nasal passageway. The feeding tube may then be cut to the desired length and a connector can be affixed to the proximal end of the feeding tube to allow a feeding pump, or the like, to be connected to the enteral feeding tube to provide nourishment to the patient. The connector could be any type of connector such as a straight through type connector, or a "Y" connector if it is necessary to have two inlet ports into the feeding tube.

In a second embodiment of the present invention, the elongated main portion of the feeding tube is only slightly longer than the endoscope length. However, a stylet is then provided which is approximately twice the length of the feeding tube. Typically, the length of the endoscope would be approximately 100 cm, the length of the feeding tube would be in the range of 120 to 150 cm and the length of the wire stylet would be in the range of 240 to 300 cm.

The stylet has a slightly enlarged distal end which is insertable within the longitudinally extending lumen of the feeding tube. The enlarged distal end of the stylet is provided with a soft flexible tip to provide a cushion to protect the inside of the feeding tube. The enlarged distal end is sized to be larger than the side apertures in the main feeding tube portion so that the wire stylet will not exit the feeding tube within the patient's body. The proximal portion of the elongated main portion of the feeding tube immediately adjacent its proximal end is provided with a sleeve which can be heat shrunk or otherwise affixed about the proximal end of the feeding tube so as to close down the inside diameter of the feeding tube about the wire stylet and capture the stylet's enlarged distal end within the lumen of the feeding tube. The stylet would still be movable within the lumen of the elongated main portion with moderate force, however the stylet could not be totally removed from the lumen because of the stylet's enlarged distal end and the heat shrunk proximal end of the feeding tube. The proximal end of the wire stylet and feeding tube can be repositioned within the patient so that the wire stylet and proximal end of the feeding tube exits the patient's body through the nasal passageway as discussed above. The wire stylet would be pulled proximally from the feeding tube until the distal end of the wire stylet is adjacent the heat shrunk proximal end of the feeding tube. The feeding tube would then be severed at a position downstream from the enlarged distal end of the wire stylet and the connector can be affixed to the proximal end of the feeding tube and a nutrient source, as discussed above.

In a third embodiment of the present invention, a method of inserting a feeding tube in a patient so that the distal end portion is positioned past the patient's pyloric valve within the patient's intestines is disclosed which comprises the steps of: inserting an endoscope, of the type having a steerable tip and working channel capable of receiving the enteral feeding tube of the present invention, into a patient's stomach with its steerable tip adjacent the patient's pyloric valve; advancing the feeding tube or endoscope, with the feeding tube of the present invention in position within the endoscope's working chamber, past the patient's pyloric valve; holding the proximal end of the elongated main portion of the feeding tube or the proximal end of the stylet in position and removing the endoscope from about the feeding tube and stylet; removing the stylet from the internal lumen of the feeding tube; repositioning the flexible feeding tube through the patient's nasal passageway; and attaching a connector to the proximal end of the elongated main portion of the feeding tube to allow connection of the feeding tube to a feeding pump or the like to administer nutrients directly into the intestines of the patient.

BRIEF DESCRIPTION OF THE DRAWINGS

The present invention is further described and disclosed with reference to the preferred embodiments presented in the drawings and set forth below in the written description.

DESCRIPTION OF THE PREFERRED EMBODIMENTS

Figure 1:
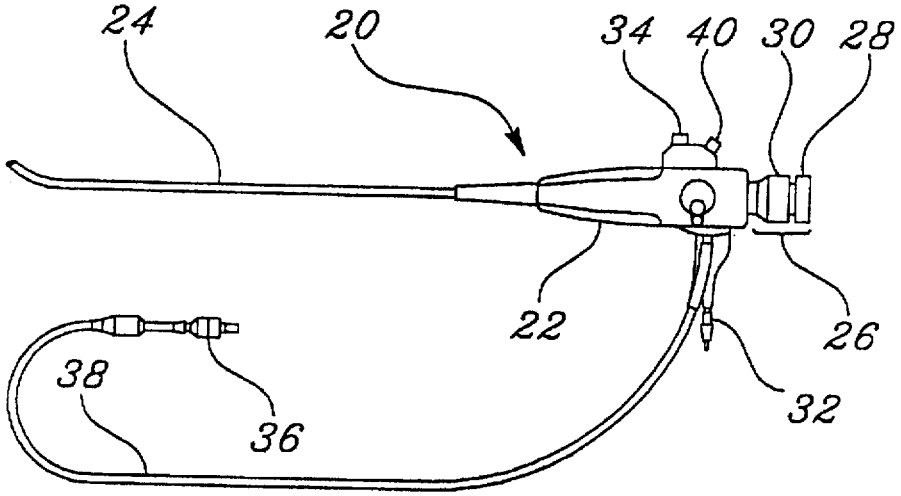
FIG. 1 shows a typical flexible fiber optic endoscope including a control body, insertion tube with instrument channel, eye piece, distal end and light guide cable.
Figure 2:
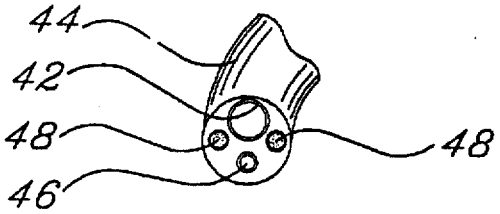
FIG. 2 is an enlarged view of the distal end of the fiber optic endoscope illustrating the working channel through which the enteral feeding tube of the present invention is passed.

Referring now to the drawings, the enteral feeding tube of the present invention is illustrated in FIGS. 3 through 12 and is generally indicated at 10, and a typical fiber optic endoscope for use with the feeding tube of the present invention is illustrated in FIGS. 1 and 2 and is generally indicated at 20. A typical fiber optic endoscope of the type used in gastrointestinal operations measures between 75 and 125 cm in length and has two main parts; a working head 22 and an insertion tube 24. The working head contains an eyepiece 26, an ocular lens 28 with a diopter adjusting ring 30, attachments for the suction tubing 32 and suction valve 34, a the cold halogen light source 36 and light source cable 38, and an access port or instrument channel inlet 40, through which various instruments can be passed through such instrument channel 42 and out the distal end 44 of the fiber optic endoscope. This working head is attached to the second part, the insertion tube 24. Tube 24 has an outer diameter of approximately 12 mm, and contains the fiber optic bundle (which terminates in an objective lens 46 at distal end 44), the light guides 48 and the continuation of instrument channel 42. The distal end of the fiber optic endoscope may have the ability to bend or be steered to allow for easy placement of the endoscope within the patient's body. However, it is not strictly necessary that the distal tip of the endoscope be provided with such a bending or steering mechanism.

Figure 3:
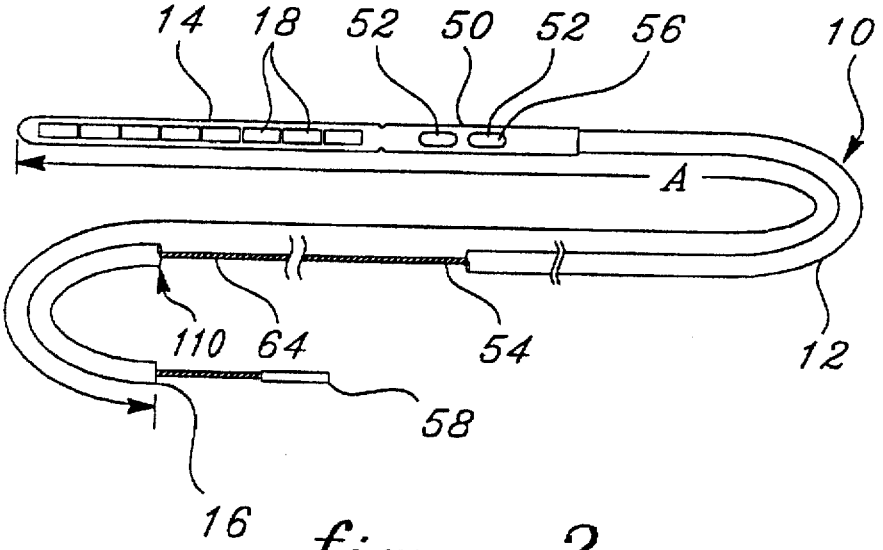
FIG. 3 is a side view, partially broken away, illustrating the various portions of an enteral feeding tube according to one embodiment of the present invention.

Referring now particularly to FIG. 3, a first embodiment of the enteral feeding tube 10 of the present invention is shown comprising an elongated flexible tubular main portion generally indicated at 12 having a longitudinal bore 11 and a weighted bolus portion generally indicated at 14 closing the distal end of the tubular main portion 12. A proximal end 16 of main portion 12 is left open as will be discussed more fully below. The feeding tube 10 is adapted to be installed in a patient utilizing an fiber optic endoscope of the type discussed above to properly position the feeding tube of the present invention within the intestines of a human patient. The bolus portion 14 is provided at the distal end of the flexible main tubular portion 12. The bolus 14 has a plurality of titanium weights 18 disposed therein for aiding in positioning, and maintaining such a position, of the enteral feeding tube within the patient. The bolus 14 is connected to the flexible main portion 12 via connector 50, and the distal end of the main portion is provided with a plurality of openings 52 therein permitting the passage of fluid into or out of the distal portion of the feeding tube.

A wire stylet 54, preferably of stainless steel, is positioned within the open proximal end 16 of the feeding tube 10 for providing added stiffness for the tube during its insertion within the endoscope. The wire stylet 54 is typically manufactured out of several strands of stainless steel wire which have been wound together to form a single wire strand. This causes the wire strand to have a spiraled outer configuration as shown at 64 in FIGS. 3 and 6. The wire stylet 54 is provided with an enlarged distal end 56 and an enlarged proximal end 58. The enlarged ends 56 and 58 may be formed by heat shrinking, dipping or molding a piece of plastic around the metal ends of the wire strand or such enlarged ends may be formed in any expedient manner so long as an enlarged end is formed having a diameter larger than the wire stylet and smaller than the inside diameter of the feeding tube 12. It may also be desirable to double the wire ends over on themselves for a short distance before applying the heat shrunk material to assist in enlarging the end and retaining the heat shrink material in place about the wire stylet. It is desirable that the enlarged distal end 56 of the wire stylet 54 be soft enough so that it will not harm the inside of the feeding tube during its insertion and removal. FIG. 7 shows the enlarged distal end 56 in position adjacent the distal end of the main feeding tube portion 12. As seen in FIGS. 3 and 7, the enlarged distal end 56 is sufficiently large to prevent the wire stylet from exiting the longitudinal bore 11 through the plurality of openings 52 provided in the distal end of the main feeding tube portion 12.

In the embodiment of the invention shown in FIG. 3, the elongated main portion 12 of the feeding tube 10 has a length "A" which is at least twice the length of the endoscope's working channel 42 which passes through the endoscope's tubular body 24 through port 40. The wire stylet 54 would have a length slightly longer than the length "A" of the elongated main portion 12 of feeding tube 10 so that its proximal end 58 would extend beyond the proximal end 16 of the feeding tube. Typically, the length of the feeding tube would be in the range of 240 to 300 cm and the length of the endoscope would be approximately 100 cm.

The enteral feeding tube 10 which comprises the flexible main portion 12 can be made of any material conventionally used for such tubes such as polyurethane, or polyvinylchloride or copolymer thereof, having an inside diameter of about 0.08 inch and an outside diameter of approximately 0.108 inch. The size of such tubes are typically designated in French units. Sizes 5–12 French are preferred for enteral feeding tubes with 8 French being the most preferred. Of course, for different applications it may be possible to use larger or smaller feeding tubes and endoscopes as is required. The enteral feeding tubes may also have various coatings provided thereon to increase their slipperiness when being inserted either within the fiber optic endoscope or within the patient's body.

Figure 6:
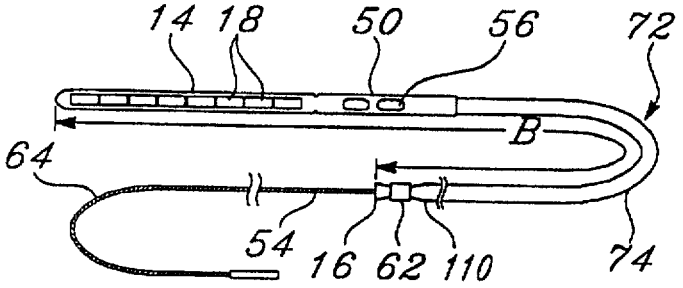
FIG. 6 is a side view, partially broken away, illustrating portions of an enteral feeding tube according to a second embodiment of the present invention.
Figure 7:
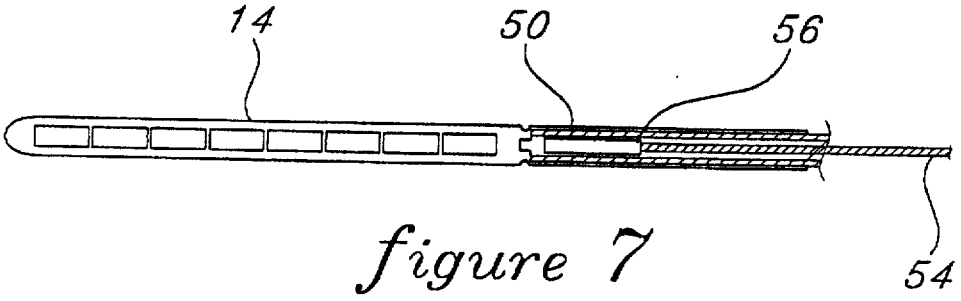
FIG. 7 is an enlarged cross-sectional view of the bolus portion of the enteral feeding tube illustrating the wire stylet fully inserted into a feeding tube.

Referring to FIG. 6, a second embodiment of the invention is shown. Like components shown in FIG. 6 that are identical to those components previously described in FIG. 3 will be designated by the same reference characters. An enteral feeding tube 72 is shown comprising an elongated flexible tubular main portion generally included at 74 and having a longitudinal bore 76. Like the feeding tube 10 of FIG. 3, feeding tube 72 has a weighted bolus portion 14 closing its distal end. However, its proximal end 16 is closed about the wire stylet as shown at 60 by use of a heat shrink sleeve 62. The heat shrink sleeve 62 is closed about the feeding tube by applications of heat as is discussed more fully below in relation to FIGS. 8 and 9. It is important that the heat shrink sleeve have a slightly higher deformation temperature than the deformation temperature of the material of the feeding tube 12. The length of the elongated main portion 74 and weighted bolus portion 14 of feeding tube 72 has a length "B" which is considerably shorter than the length "A" of the feeding tube 10 as shown in FIG. 3. The length "B" of feeding tube 72 is only slightly greater than the length of the endoscope which is approximately 100–120 cm in length. However, the wire stylet 54 shown in FIG. 6 is the same wire stylet 54 shown in FIG. 3 having a length in the range of 240 to 120 cm which is greater than twice the length of the endoscope.

Figure 8:
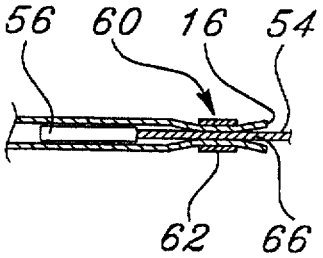
FIG. 8 is an enlarged cross-sectional view of the proximal end of the enteral feeding tube illustrating the wire stylet backed out of the feeding tube so that the enlarged distal portion of the stylet is adjacent a first embodiment of the heat shrunk proximal portion of the feeding tube.

Referring to FIG. 8, an enlarged view of one manner of closing the proximal end 16 of the feeding tube 72 is shown in more detail. The wire stylet 54 is shown almost totally retracted from feeding tube 72 such that the enlarged distal end 56 of wire stylet 54 is adjacent the heat shrunk or compressed proximal end portion 60 of the feeding tube. As can be seen in FIG. 8, the wire stylet cannot be totally removed from the feeding tube 72, the importance of which will be more fully discussed below. Furthermore, the proximal end portions 60 of the feeding tube 72 is shown closed about the wire stylet 54. The heat shrink sleeve 62 is heated to cause it to shrink about the feeding tube which shrinks the inner diameter of the feeding tube 72 to compress about the wire stylet 54. Since heat is transferred between the heat shrink sleeve 62 and feeding tube, the inside surface of the feeding tube at this juncture takes on the spiraled configuration of the wire stylet 54. This is beneficial because it provides a resistance to longitudinal movement of the wire stylet relative to the feeding tube. It is also beneficial because then as the wire stylet 54 is turned relative to the feeding tube, the spiraled wire stylet will tend to travel either into or out of the feeding tube 72 depending on whether the wire stylet 54 is turned clockwise or counterclockwise. Of course, upon a more forceful pulling or pushing force the wire stylet 54 can be moved longitudinally within the longitudinal bore 11 of the feeding tube 12 without rotating the wire stylet 54.

Figure 9:
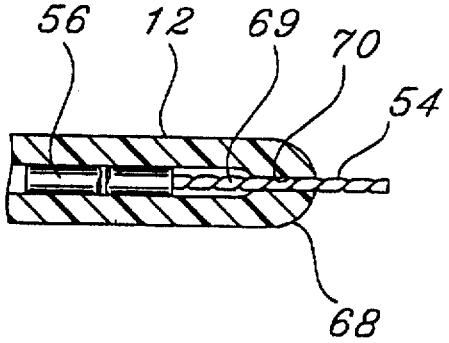
FIG. 9 is an enlarged cross-sectional view of the proximal end of the enteral feeding tube illustrating the wire stylet backed out of the feeding tube so that the enlarged distal end portion of the stylet is adjacent a second embodiment of the molded proximal portion of the feeding tube.

Referring to FIG. 9 a second manner of closing the proximal end of the feeding tube 72 is shown. A domed heat mold (not shown) having a hole in it for the wire stylet to pass through is passed down the wire such that heat can be applied directly to the proximal end 68 of the feeding tube 72. The proximal end 68 will take on a thickened domed shape 69 which matches the internal cavity of the mold. The inside diameter 70 of the feeding tube which abuts the wire stylet 54 will take on the spiraled configuration of the wire stylet in a similar manner to the inside 66 of the proximal end 16 of the feeding tube of FIG. 8. Of course, either of these methods of closing the proximal end 16 of feeding tube 72 could be utilized to close the proximal end 16 of feeding tube 12, shown in FIG. 3, if desired.

Figure 4:
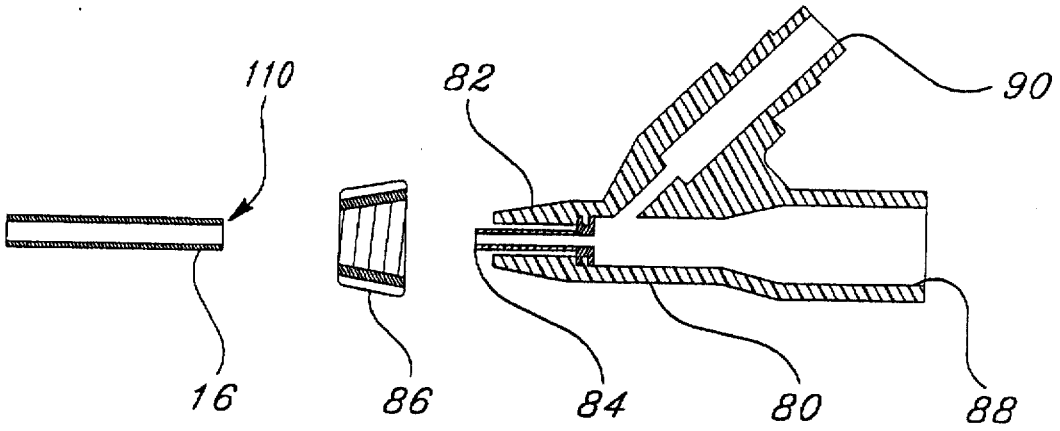
FIG. 4 is an enlarged cross-sectional view of the "Y" shaped connector for use with the enteral feeding tube of the present invention.
Figure 5:
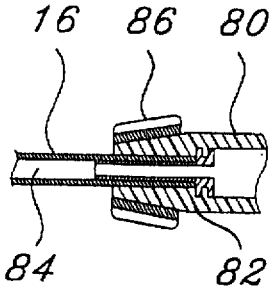
FIG. 5 is an enlarged cross-sectional partial view of the "Y" shaped connector illustrating the manner of connection of the connector to the proximal end of the enteral feeding tube.

FIGS. 4 and 5 show a typical connector 80 which could be utilized to cap off the proximal end 16 of the feeding tubes of FIGS. 3 and 6, once the wire stylet has been removed from the feeding tube in the manner described in more detail below. The connector 80 could be a single tube connector or have a "Y" shaped configuration as shown in FIG. 4. The distal end 82 of the connector 80 is provided with a metal or plastic eyelet 84 which is snap-fit into the distal end of the connector 80. The connector 80 which is manufactured from a PVC or similar material could also be molded about the eyelet 84 to securely retain the eyelet within the connector 80. A wire-nut type winged compressor 86 is provided which can be slid over the proximal end 16 of the feeding tube prior to assembly and then threaded onto the distal end 82 of connector 80 to compress the proximal end 16 of the feeding tube between the distal end walls 82 of connector 80 and the eyelet 84 as shown in FIG. 5 to securely hold the connector 80 on the feeding tube. The eyelet 84 maintains the diameter of the internal lumen of the feeding tube 12 or 72 while it is under compression by the wire-nut type winged compressor 86. The connector 80 is further provided with a pair of entrance ports 88 and 90 for connection to a feeding pump and other medical apparatus as is necessary.

OPERATION

Referring now to FIGS. 10–15, the procedure utilized for endoscopically installing the feeding tubes 10 and 72 of FIGS. 3 and 6 in a patient 94 is illustrated. In this regard, before a feeding tubes with wire stylet is installed in the patient 94, it would be inserted within the instrument channel 42 (FIG. 2) through port 40 such that the distal tip of the bolus portion 14 is adjacent the distal end 44 of the endoscope's insertion tube 24.

Figure 10:
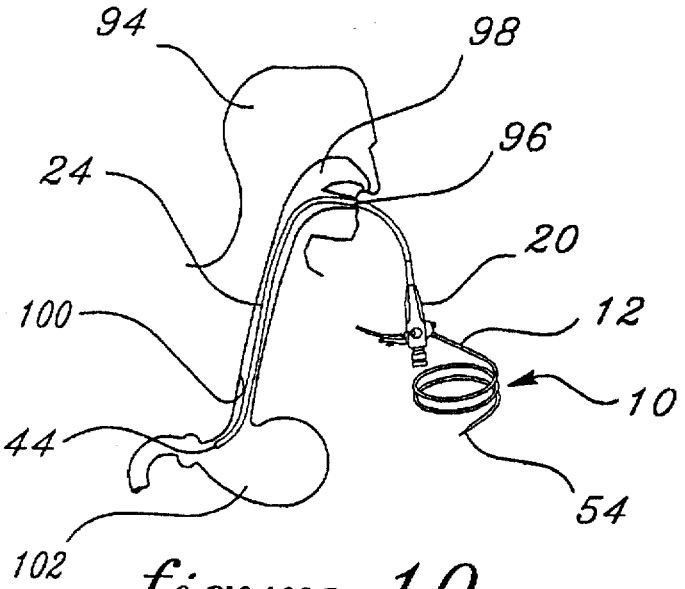
FIGS. 10 and 11 are sequential views illustrating the method of installation of the fiber optic endoscope and enteral feeding tube of FIG. 3 into a human patient.
Figure 11:
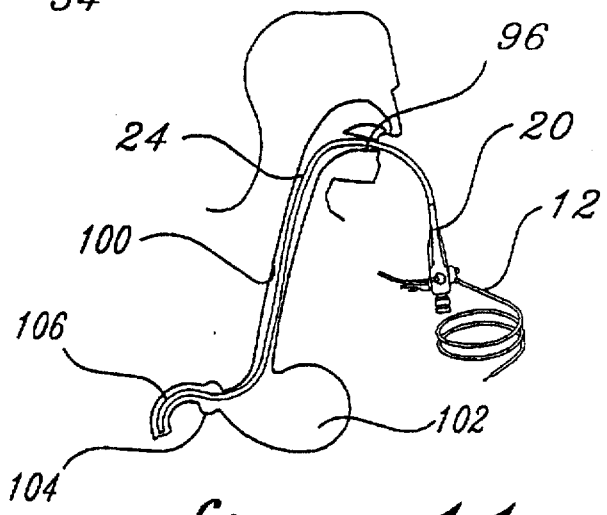
Figure 12:
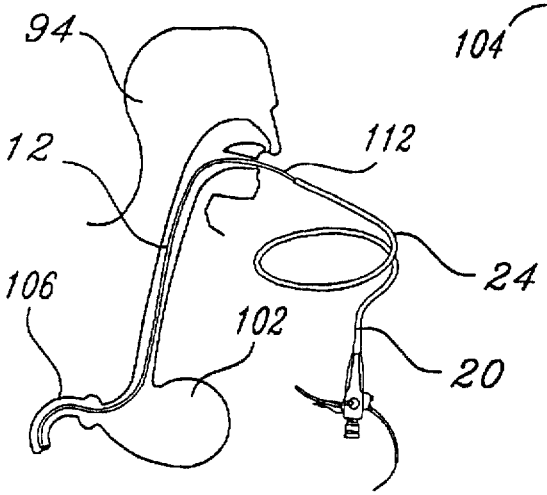
FIG. 12 is a partial cross-sectional view of the enteral feeding tube of FIG. 3 inserted in a human patient with the endoscope backed out of the patient.

Referring specifically to FIGS. 10–12, the feeding tube 10 of FIG. 3 is shown in place within the endoscope's instrument channel. As shown in FIG. 10, the feeding tube 10 has its wire stylet 54 fully inserted to provide increased rigidity in the main portion 12 during installation of the feeding tube 10 within the endoscope and within the patient 94. The endoscope 20 is shown such that its insertion tube 24 has been passed through the patient's mouth 96, throat 98, esophagus 100 and into the stomach 102 of the patient 94. Once the endoscope has been passed into the patient's stomach 102, it can be further advanced past the pyloric valve 104 of the patient and into the duodenum area 106 of the large intestine, as shown in FIG. 11. Alternatively, the endoscope 20 could be held in place and the feeding tube with wire stylet could be advanced by the medical personnel such that only the feeding tube 10 is advanced into the duodenum area 106 of the patient's large intestine.

It is important to advance the feeding tube or endoscope with feeding tube positioned therein sufficiently within the duodenum area 106 such that the openings 52 of the main feeding tube portion 12 are positioned past the pyloric valve and into the duodenum area 106 of the patient for direct enteral feeding into the patient's intestines. The medical personnel using such an endoscope would be able to use the steering tip of said endoscope to assist in properly directing the feeding tube for advancement into the appropriate intestinal area of the patient 94. Further, such medical personnel would utilize the endoscope's eyepiece 26 and light source 36 to allow proper placement of the feeding tube.

As peen in FIG. 12, once the feeding tube 10 has been properly positioned within the patient, the endoscope 20 can be backed off of the feeding tube without disturbing the position of the feeding tube. This is accomplished by holding the feeding tube 10 at a position proximal to the endoscope such as at 110 while pulling the endoscope 20 backwards until the distal end 44 has been totally removed from the patient. Of course, the medical personnel would be grasped at various points 110 which would advance proximally toward their proximal end 16 of feeding tube 12 as the endoscope is continued to be removed from about the feeding tube. The feeding tube can now be grasped at 112 and the endoscope can be totally removed from about the feeding tube 10 and wire stylet 54. The connection of the connector 80 to the proximal end 16 of the feeding tube is described below in conjunction with both embodiments of the feeding tube.

Figure 13:
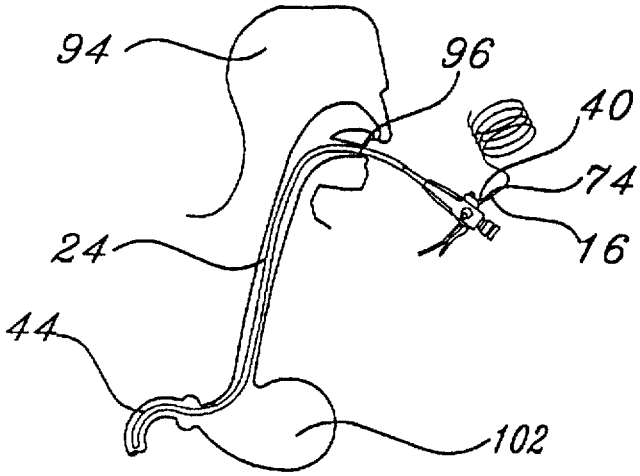
FIG. 13 is a partial cross-sectional view of the enteral feeding tube of FIG. 6 inserted in a human patient through a fiber optic endoscope.
Figure 14:
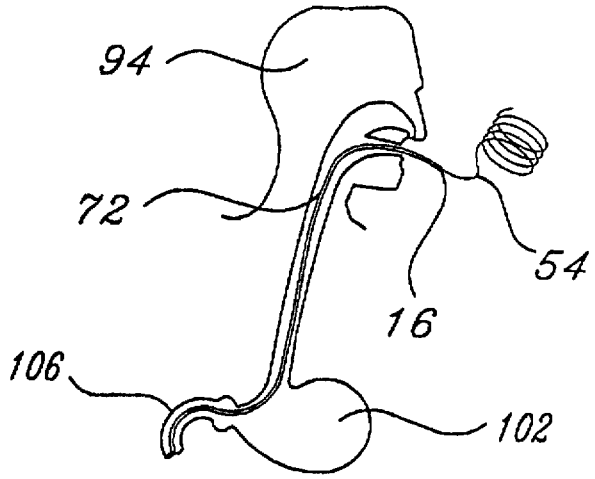
FIG. 14 is a partial cross-sectional view of the enteral feeding tube of FIG. 13 with the endoscope removed from about the feeding tube and showing the wire stylet partially removed from the feeding tube such that only the enlarged end of the wire stylet is captured within the feeding tube.

Referring now to FIGS. 13 and 14, the procedure for endoscopically installing the feeding tube of FIG. 6 is shown in more detail. As can be seen in FIG. 13, the main portion 74 of feeding tube 72 is long enough to extend from the distal end 44 of the endoscope to a position where the proximal end 16 of feeding tube 72 extends just outside of the endoscope's instrument channel inlet 40. However, it is not critical that the main feeding tube portion 74 extend outside the endoscope, it is important only that the feeding tube be long enough to extend from the patient's mouth 96 and have enough length to attach the connector 80 as will be more fully discussed below.

The endoscope 20 is inserted into the patient through the mouth 96, throat 98, esophagus 100 and into the patient's stomach 102. The distal steering tip of the endoscope is manipulated so that the endoscope's distal end 44 is aimed at the pyloric valve 104 and either the endoscope with feeding tube 72 positioned therein or just the feeding tube through manipulation of the wire stylet 54 is advanced through the pyloric valve 104 and into the duodenum area 106 of the large intestine as shown in FIG. 13.

The feeding tube 72 is held in position by grasping the wire stylet 54 and holding it stationary while the endoscope 20 is backed off the feeding tube 72 and removed from the patient such that only the feeding tube 72 and wire stylet 54 are installed within the patient 94 as shown in FIG. 14.

Figure 15:
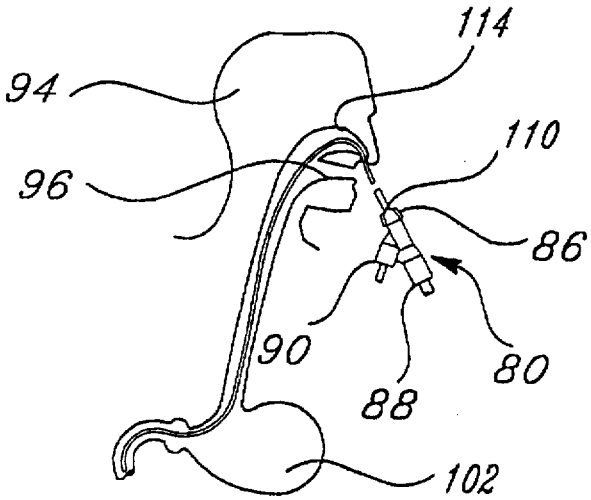
FIG. 15 is a partial cross-sectional view of an enteral feeding tube of either FIGS. 3 or 6 inserted in a human patient after removal of the fiber optic endoscope and wire stylet, illustrating the connection of a "Y" shaped connector to the proximal end of the feeding tube.

Referring to FIG. 15, the wire stylet is shown removed from the feeding tube and the connector 80 is secured to the proximal end of the feeding tube. The procedure for doing this is similar with either the feeding tube from FIG. 3 or FIG. 6 except that the feeding tube 10 of FIG. 3 does not have a heat shrink sleeve about the proximal end of the main feeding tube portion 12 therefore the discussion which follows applies to both feeding tubes 10 and 72 and wire stylets 54. First, the wire stylet is removed from the longitudinal bore of the feeding tube. In the feeding tube 72 of FIG. 6, the wire stylet 54 is pulled or rotated in a counterclockwise manner so that the wire stylet is almost totally removed from the feeding tube 72. The enlarged distal end 56 of the wire stylet 54 is now adjacent the heat shrunk sleeve 62 or molded end 68 at the proximal end 16 of the feeding tube 72 as shown in FIGS. 8 and 9. The feeding tube is then severed at 110 or any convenient length (FIG. 6) at a point distal to the wire stylet's distal end 56 and proximal to where the feeding tube 72 exits from the patient's mouth 96. The proximal end of the flexible feeding tube may then be repositioned from exiting the patient's mouth to a position where the tube exits through the patient's nasal passageway 114. Typically, a nasal tube (not shown) is used to assist the medical personnel in repositioning the feeding tube through the patient's nose. The nasal tube is positioned within the patient's nasal passageway and the flexible feeding tube is passed through the nasal tube from inside the patient's mouth. The proximal end of the feeding tube is pushed/pulled through the nasal tube until all slack has been removed from the patient. Of course, during this procedure the main portion 12 of the feeding is held stationary so as to not disturb the distal placement of the feeding tube within the patient's intestines.

The final step involves the attachment of the connector 80 to the proximal end of the feeding tube. The winged compressor nut 86 is placed over the proximal end of feeding tube 110 and is inserted into the distal end 82 of the connector 80 as shown in FIG. 5. The winged compressor nut 86 is then threaded into the distal end 82 of connector 80 to compress the proximal end 110 between the distal connector end 82 at eyelet 84 to securely hold the connector onto the end of the feeding tube 10 or 72 as shown in FIG. 15. The connector 80 and feeding tube may now be attached to a feeding pump or the like to administer nutrients directly into the intestines of the patient.

It is seen therefore that the instant invention provides a gastroenteric feeding tube which is effectively adapted for endoscopic placement. Effective benefits are provided by the overall construction of the main portions 12 and 74 of feeding tubes 10 and 72; the various lengths "A" and "B" of said main portions relative to the length of the endoscope; and design of the connector for use therewith. In particular, these features cooperate to substantially facilitate the endoscopic placement of the feeding tube in a patient, such as patient 94. They also cooperate to minimize the time required for insertion and stress to the patient during installation procedures since no other instruments besides the endoscope need be inserted within the patient during the installation procedures. Accordingly, for these reasons as well as the other reasons set forth above, it is seen that the feeding tube of the instant invention represents a significant advancement in the art which has substantial merit.

While there is shown and described herein certain specific structures embodying the invention, it will be manifest to those skilled in the art that various modifications and rearrangements of the parts may be made without departing from the spirit and scope of the underlying inventive concept and that the same is not limited to the particular forms shown and described herein except insofar as indicated by the scope of the appended claims.

We claim:

1. A gastroenteric feeding tube in combination with an endoscope for endoscopic placement of the feeding tube within the gastrointestinal tract of a living being, said combination comprising:

the elongated endoscope having an instrument channel, an illumination means and a viewing means throughout its entire length;

the feeding tube having an elongated flexible tubular body having a longitudinally extending lumen therein, the tubular body having distal and proximal ends and at least one side aperture therein which extends between the lumen and the exterior of the tubular body adjacent the distal end of said lumen, the tubular body adapted to be inserted within the instrument channel of the endoscope; and the overall longitudinal length of the feeding tube being greater than twice the length of the instrument channel of the endoscope so that the endoscope can be removed from about the feeding tube without disturbing the position of the side aperture and distal end of the tubular body of said feeding tube within the gastrointestinal tract of the living beings, said elongated tubular body further comprising an elongated flexible main portion having the longitudinally extending lumen therein, the main portion having distal and proximal ends and at least one side aperture which extends between the lumen and the exterior surface of the main portion adjacent the distal end of the main portion; and a weighted bolus portion extending in substantially aligned relation from the distal end of the main portion and terminating in a free end, the weighted bolus portion and elongated main portion adapted to be inserted within the instrument channel of the endoscope, said feeding tube further comprising a wire stylet having a distal and a proximal end, the distal end adapted to be inserted within the proximal end of and extending within the lumen of the elongated main portion to provide the feeding tube with additional stiffness during insertion of the feeding tube within either of the instrument channel of the endoscope or the living being, said wire stylet further comprising an enlarged distal end having a diameter greater than the diameter of the wire stylet and smaller than the inside diameter of the main portion lumen, the proximal end of the main portion of the feeding tube further including a closure means which closes the inside diameter of the lumen about the wire stylet to capture the enlarged end of the wire stylet within the lumen without preventing longitudinal movement of the wire stylet within the lumen of the feeding tube.

2. The combination of claim 1, wherein the enlarged distal end of the wire stylet includes a soft flexible tip to provide a cushion to protect the inside surface of the lumen of the tubular body during insertion of the wire stylet into said lumen.

3. The combination of claim 1, the closure means comprising a heat shrinkable sleeve positioned about the main portion of the feeding tube adjacent its proximal end such that upon application of heat the sleeve contracts about the outside surface of the main portion to compress the inside surface of the lumen about the wire stylet.

4. The combination of claim 3, the wire stylet further comprising a plurality of wire strands wrapped together to form a single wire strand such that the wire stylet has a spiraled outer configuration.

5. The combination of claim 4, wherein the contracted inside surface of the main feeding tube portion has a matching spiraled configuration to the outer configuration of the wire stylet so that upon rotation of the wire stylet relative to the main feeding tube portion, the wire stylet will travel either further into or out of the lumen depending whether the wire stylet is rotated in a clockwise or counterclockwise direction.

6. A gastroenteric feeding tube in combination with an endoscope for endoscopic placement of the feeding tube within the gastrointestinal tract of a living being, said combination comprising:

the elongated endoscope having an instrument channel, an illumination means and a viewing means throughout its entire length;

the feeding tube having an elongated flexible tubular body having a longitudinally extending lumen therein, the tubular body having distal and proximal ends and at least one side aperture adjacent the lumen's distal end and extending between the lumen and the exterior surface of the tubular body;

a wire stylet having distal and proximal ends, the distal end adapted to be inserted within the proximal end of and extending within the lumen of the elongated tubular body such that the distal end of the wire stylet is positioned adjacent the distal end of the lumen to provide the feeding tube with additional stiffness during insertion of the feeding tube within the instrument channel of the endoscope or the living being; and the overall longitudinal length of the feeding tube with wire stylet fully inserted within the tubular body being greater than twice the length of the instrument channel of the endoscope so that the endoscope can be removed from about the feeding tube without disturbing the position of the side aperture and distal end of the tubular body of said feeding tube withing the gastrointestinal tract of a living being, the wire stylet further comprising an enlarged distal end having a diameter greater than the diameter of the wire stylet and smaller than the inside diameter of the lumen of the tubular body, wherein the enlarged distal end of the wire stylet has a diameter larger than the size of the side aperture in the tubular body, the proximal end of the tubular body of the feeding tube further including a closure means which closes the inside diameter of the lumen about the wire stylet to capture the enlarged end of the wire stylet within the lumen without preventing longitudinal movement of the wire stylet within the lumen of the feeding tube, the closure means comprising a heat shrinkable sleeve positioned about the tubular body of the feeding tube adjacent its proximal end such that upon application of heat the sleeve contracts about the outside surface of the tubular body to compress the inside surface of the lumen about the wire stylet.

7. The combination of claim 6, the elongated tubular body further comprising:

an elongated flexible main portion having the longitudinal extending lumen therein, the main portion having distal and proximal ends and the at least one side aperture which extends between the lumen and the exterior surface of the main portion adjacent the distal end of the main portion; and a weighted bolus portion extending in substantially aligned relation from the distal end of the main portion and terminating in a free end, the weighted bolus portion and elongated main portion adapted to be inserted within the instrument channel of the endoscope.

8. The combination of claim 6, wherein the enlarged distal end of the wire stylet includes a soft flexible tip to provide a cushion to protect the inside surface of the lumen of the tubular body during insertion of the wire stylet into said lumen.

9. The combination of claim 6, the wire stylet further comprising a plurality of wire strands wrapped together to form a single wire strand such that the wire stylet has a spiraled outer configuration.

10. The combination of claim 9, wherein the contracted inside surface of the tubular body has a matching spiraled configuration to the outer configuration of the wire stylet so that upon rotation of the wire stylet relative to the main feeding tube portion, the wire stylet will travel either further into or out of the lumen depending whether the wire stylet is rotated in a clockwise or counterclockwise direction.

11. A method of endoscopically inserting a feeding tube within the gastrointestinal tract of a living being comprising the steps:

placing a feeding tube into an instrument channel of an endoscope, the feeding tube having an elongated flexible tubular body with a longitudinally extending lumen therein, the tubular body having distal and proximal ends and at least one side aperture which extends between the lumen and the exterior of the tubular body adjacent the distal end of the lumen, the endoscope further including an illumination means and a viewing means and having a steerable distal tip, the feeding tube being positioned within the instrument channel of the endoscope such that the distal end of the tubular body is adjacent a distal end of the instrument channel of the endoscope, the feeding tube having a longitudinal length which is greater than twice the length of the endoscope's instrument channel;

inserting the distal end of the endoscope through a living being's mouth and down the living being's alimentary tract to the living being's stomach, and positioning the steerable tip of the endoscope so that it is facing the pyloric valve of the living being;

advancing the feeding tube within the instrument channel past the pyloric valve and into the intestinal tract of the living being;

removing the endoscope from about the feeding tube while holding the proximal end of the feeding tube stationary so as to not disturb the position of the distal end of the feeding tube within the intestinal tract of the living being;

attaching a connector to the proximal end of the feeding tube so that it is in fluid communication with the lumen of the feeding tube; and connecting the connector to a source of fluid whereby fluid passes from the source of fluid through the connector and lumen to the side aperture adjacent the distal end of the feeding tube where the fluid leaves the tube and enters the intestinal tract of the living being.

12. The method of claim 11 wherein the feeding tube further comprises:

an elongated flexible main portion having the longitudinally extending lumen therein, the main portion having distal and proximal ends and the at least one side aperture which extends between the lumen and the exterior surface of the main portion adjacent the distal end of the main portion; and a weighted bolus portion extending in substantially aligned relation from the distal end of the main portion and terminating in a free end, the weighted bolus portion and elongated main portion adapted to be inserted within the instrument channel of the endoscope.

13. The method of claim 12 wherein the feeding tube further comprises:

a wire stylet having distal and proximal ends, the distal end adapted to be inserted within the proximal end of and extending within the lumen of the elongated tubular body to provide the feeding tube with additional stiffness during insertion of the feeding tube within either of the instrument channel of the endoscope or the living being.

14. The method of claim 13 including the step of removing the wire stylet from the lumen while leaving the feeding tube in position through the living being's mouth, alimentary tract and intestinal tract after the step of removing the endoscope from about the feeding tube.

15. The method of claim 14 including the subsequent step of repositioning the feeding tube through the nasal passageway of the living being before attaching the connector to the proximal end of the feeding tube.

16. The method of claim 11 wherein the step of placing the feeding tube within the instrument channel of the endoscope occurs immediately after the step of inserting the endoscope within the mouth and intestinal tract of the living being.

17. A method of inserting a feeding tube within the gastrointestinal tract of a patient through an endoscope having an instrument channel, an illumination means and a viewing means through its entire length and having a steerable distal tip comprising the steps of:

placing the feeding tube into the instrument channel of the endoscope, the feeding tube having an elongated flexible tubular body having a longitudinally extending lumen therein, the tubular body having distal and proximal ends and at least one side aperture adjacent the distal lumen and extending between the lumen and the exterior surface of the tubular body, and a wire stylet having distal and proximal ends, the distal end adapted to be inserted within the proximal end of and extending within the lumen of the elongated tubular body such that the distal end of the wire stylet is positioned adjacent the distal to provide the feeding tube with additional stiffness during insertion of the feeding tube within the instrument channel of the endoscope or the patient, the overall longitudinal length of the feeding tube with wire stylet fully inserted within the tubular body being greater than twice the length of the instrument channel of the endoscope;

inserting the distal end of the endoscope through a patient's mouth and down the patient's alimentary tract to the patient's stomach;

positioning the steerable tip of the endoscope so that it is facing the patient's pyloric valve;

advancing the feeding tube within the instrument channel so that its distal end is past the patient's pyloric valve and into the patient's intestinal tract;

removing the endoscope from about the feeding tube while holding the proximal end of the wire stylet stationary so as to not disturb the position of the distal end of the feeding tube within the patient's intestinal tract;

attaching a connector to the proximal end of the feeding tube; and connecting the connector to a source of fluid whereby fluid passes from the source of fluid through the lumen of the feeding tube and into the intestinal tract of the patient.

18. The method of claim 17 wherein the feeding tube further comprises:

an elongated flexible main portion having the longitudinal extending lumen therein, the main portion having distal and proximal ends and the at least one side aperture which extends between the lumen and the exterior surface of the main portion adjacent the distal end of the main portion;

a weighted bolus portion extending in substantially aligned relation from the distal end of the main portion and terminating in a free end, the weighted bolus portion and elongated main portion adapted to be inserted within the instrument channel of the endoscope;

the wire stylet further comprising an enlarged distal end having a diameter greater than the diameter of the wire stylet and smaller than the inside diameter of the lumen of the main portion; and the proximal end of the main portion of the feeding tube further including a closure means which closes the inside diameter of the lumen about the wire stylet to capture the enlarged end of the wire stylet within the lumen without preventing longitudinal movement of the wire stylet within the lumen of the feeding tube.

19. The method of claim 18 further including the steps of:

removing the wire stylet from the lumen while leaving the feeding tube in position through the patient's mouth, alimentary tract and intestinal tract after the step of removing the endoscope from about the feeding tube;

repositioning the feeding tube's main portion and wire stylet through the patient's nasal passageway;

pulling the wire stylet proximally from the lumen of the main feeding tube portion until the enlarged distal end is adjacent the constructed proximal end of the main portion;

cutting the main feeding tube portion at a position distal to where the enlarged distal end of the wire stylet is resting so that the wire stylet and main feeding tube position are separated and the connector can be connected to the proximal end of the main feeding tube portion.

20. The method of claim 19 wherein the step of placing the feeding tube within the instrument channel of the endoscope takes place immediately after the step of inserting the endoscope within the patient's mouth and intestinal tract.

21. A gastroeteric feeding tube in combination with an endoscope for endoscopic placement of the feeding tube within the gastrointestinal tract of a living being, said combination comprising:

the elongated endoscope having an instrument channel, an illumination means and a viewing means throughout its entire length;

the feeding tube having an elongated flexible tubular body having a longitudinally extending lumen therein, the tubular body having distal and proximal ends and at least one side aperture therein which extends between, the lumen and the exterior of the tubular body adjacent the distal end of said lumen, the tubular body adapted to be inserted within the instrument channel of the endoscope; and the overall longitudinal length of the feeding tube being greater than twice the length of the instrument channel of the endoscope so that the endoscope can be removed from about the feeding tube without disturbing the position of the side aperture and distal end of the tubular body of said feeding tube within the gastrointestinal tract of the living being, the feeding tube further comprising a wire stylet having distal and proximal ends, the distal end adapted to be inserted within the proximal end of and extending within the lumen of the elongated tubular body to provide the feeding tube with additional stiffness during insertion of the feeding tube within either of the instrument channel of the endoscope or the living being, the wire stylet further comprising an enlarged distal end having a diameter greater than the diameter of the wire stylet and smaller than the inside diameter of the lumen of the tubular body, wherein the enlarged distal end of the wire stylet has a diameter larger than the size of the side aperture in the tubular body.

* * * * *